US009062879B2

(12) United States Patent
O'Donnell

(10) Patent No.: US 9,062,879 B2
(45) Date of Patent: Jun. 23, 2015

(54) INSHOT GAS BURNER

(75) Inventor: Michael J. O'Donnell, Avon, OH (US)

(73) Assignee: BECKETT GAS, INC., North Ridgeville, OH (US)

( * ) Notice: Subject to any disclaimer, the term of this patent is extended or adjusted under 35 U.S.C. 154(b) by 224 days.

(21) Appl. No.: 13/599,488

(22) Filed: Aug. 30, 2012

(65) Prior Publication Data

US 2013/0048764 A1 Feb. 28, 2013

Related U.S. Application Data

(60) Provisional application No. 61/529,478, filed on Aug. 31, 2011.

(51) Int. Cl.
*F23D 14/08* (2006.01)

(52) U.S. Cl.
CPC ..... *F23D 14/08* (2013.01)

(58) Field of Classification Search
CPC ..... F23D 14/02; F23D 14/08; F23D 14/58; F23D 14/62; F23D 14/70; F23D 14/84; F23D 2900/00003; F23D 2900/00013; B05B 1/02; B05B 1/04; B05B 1/042; B05B 1/044
USPC ..... 431/286, 354, 355; 239/8, 11, 265.19, 239/396, 397, 498, 518, 522–524, 533.2, 239/552, 568, 592, 594
See application file for complete search history.

(56) References Cited

U.S. PATENT DOCUMENTS 1,424,739 A * 8/1922 Reeves ..... 239/594
1,445,208 A * 2/1923 Forward ..... 239/592
1,552,438 A * 9/1925 Leach ..... 110/263
1,791,360 A * 2/1931 Kerr ..... 239/407
1,925,183 A * 9/1933 Forster ..... 431/349
1,954,873 A * 4/1934 Gwathmey ..... 239/404
2,055,529 A * 9/1936 Hahn ..... 431/207
2,116,863 A * 5/1938 Dinley ..... 239/594
2,130,173 A * 9/1938 Barnes ..... 239/595
2,142,014 A * 12/1938 Zink ..... 239/419
2,188,116 A * 1/1940 Neale et al. ..... 239/429
2,985,233 A * 5/1961 Stellmach ..... 239/429
2,987,119 A * 6/1961 Alger ..... 239/523
3,288,377 A * 11/1966 Van De Roer ..... 239/433
3,687,375 A * 8/1972 Griffiths ..... 239/557

(Continued)

FOREIGN PATENT DOCUMENTS

EP 597645 A1 * 5/1994 ..... F23D 14/04
JP 2002264973 A * 9/2002 ..... B65D 83/00

OTHER PUBLICATIONS

Kageyama et al., JP 2002264973 A, Sep. 2002, English Machine Translation.*

*Primary Examiner* — Jorge Pereiro
(74) *Attorney, Agent, or Firm* — Tarolli, Sundheim, Covell & Tummino LLP

(57) ABSTRACT

A burner nozzle for use in burning a gas/air mixture includes a tubular member that extends along a centerline and has a mixture supply passage extending from an inlet end that receives air and gas to an outlet end. The outlet end includes a plurality of exit portions in fluid communication with the inlet end. The exit portions are positioned on opposing sides of cooperating dimples formed in the tubular member. The dimples are configured to shape the exit portions into nozzles having a cross-sectional area that decreases in a direction towards the outlet end.

20 Claims, 4 Drawing Sheets

(56) References Cited

U.S. PATENT DOCUMENTS

| | | | | | |
|---|---|---|---|---|---|
| 3,997,287 | A | * | 12/1976 | Schutte | 431/355 |
| 4,645,140 | A | * | 2/1987 | Bevilaqua et al. | 244/12.1 |
| 5,035,609 | A | * | 7/1991 | Riehl | 431/286 |
| 5,131,839 | A | * | 7/1992 | Riehl | 431/286 |
| 5,186,620 | A | | 2/1993 | Hollingshead | |
| 5,188,526 | A | * | 2/1993 | Riehl | 431/286 |
| 5,244,382 | A | | 9/1993 | Riehl | |
| 5,257,499 | A | * | 11/1993 | Leonard | 60/39.23 |
| 5,286,190 | A | * | 2/1994 | Riehl | 431/286 |
| 5,297,955 | A | * | 3/1994 | Riehl | 431/286 |
| 5,318,439 | A | * | 6/1994 | Sigler | 431/286 |
| 5,324,195 | A | * | 6/1994 | Sigler | 431/286 |
| 5,336,082 | A | * | 8/1994 | Riehl | 431/286 |
| 5,372,498 | A | * | 12/1994 | Sigler | 431/286 |
| 5,402,567 | A | * | 4/1995 | Riehl | 29/890.01 |
| 5,445,519 | A | * | 8/1995 | Sigler | 431/286 |
| 6,190,163 | B1 | | 2/2001 | Maricic et al. | |
| 6,364,657 | B1 | | 4/2002 | O'Donnell | |
| 6,478,577 | B1 | | 11/2002 | Maricic et al. | |
| 6,916,174 | B2 | | 7/2005 | O'Donnell et al. | |
| 2012/0247595 | A1 | * | 10/2012 | Raftis et al. | 137/883 |

* cited by examiner

INSHOT GAS BURNER

RELATED APPLICATIONS

This application claims the benefit of U.S. Provisional Application No. 61/529,478, filed Aug. 31, 2011, the entirety of which is incorporated herein by reference.

TECHNICAL FIELD

The invention relates to burners and, more specifically, relates to an insertless inshot gas burner suitable for use in appliances and the like.

BACKGROUND

Inshot gas burner nozzles, such as used in furnaces and many appliances, generally comprise a venturi tube which diverges from its input end to an enlarged output end. In some constructions, a burner head insert made of sintered or powdered metal has outlet openings and is mounted in the outlet end of the tube. One example of such an insert is described in U.S. Pat. No. 5,186,620 to Hollingshead, which is incorporated herein by reference in its entirety. In operation, gas is injected into the inlet end of the nozzle, entraining air into the nozzle with it. This primary air/gas mix flows through the tube to the burner head or flame retention insert. The primary air/gas mix passes through the insert and burns as it exits the insert, thereby forming a cone of flame projecting from the outer face. Secondary air flows around the outside of the venturi tube and is entrained in the burning mixture around the outside of the insert in order to complete combustion.

Other inshot burner designs have incorporated an "insertless" configuration. These burners have an advantage of being less costly because they have less parts and lower material content. Examples of these types can be found in U.S. Pat. No. 5,445,519 to Sigler U.S. Pat. No. 5,833,449 to Knight. The disadvantage of these burners is that they have a very limited range of firing rates due to the relatively open discharge end, i.e., low port loading, with minimal flame retention features. A high firing rate will cause flame instability and flame lift off, which results in excessive noise and poor combustion, i.e., high carbon monoxide (CO). On the other hand, a low rate can cause flashback. Flashback is the burning of the gas within the burner nozzle itself, which can cause overheating and deterioration of the nozzle. There is therefore a need for an inshot gas burner nozzle that is inexpensive and easy to make while maintaining flame stability over a wide range of firing rates.

SUMMARY OF THE INVENTION

In accordance with the present invention, a burner nozzle for use in burning a gas/air mixture includes a tubular member that extends along a centerline and has a mixture supply passage extending from an inlet end that receives air and gas to an outlet end. The outlet end includes a plurality of exit portions in fluid communication with the inlet end. The exit portions are positioned on opposing sides of cooperating dimples formed in the tubular member. The dimples are configured to shape the exit portions into nozzles having a cross-sectional area that decreases in a direction towards the outlet end.

In accordance with another aspect of the present invention, a burner nozzle extends along a centerline from an inlet end to an outlet end for use in burning a gas/air mixture. The burner nozzle includes first and second stamped members secured together to form an enclosed mixture supply passage that extends from the inlet end to the outlet end. The mixture supply passage includes a frustoconical converging portion for receiving air and gas at the inlet end. A central portion is in fluid communication with the converging portion and is tapered relative to the central axis. A plurality of exit portions at the outlet end is in fluid communication with the converging portion. The exit portions are positioned on opposing sides of cooperating dimples formed in the first and second stamped members. The dimples are configured to shape the exit portions into nozzles having a cross-sectional area that decreases in a direction that extends towards the outlet end.

BRIEF DESCRIPTION OF THE DRAWINGS

The foregoing and other features of the present invention will become apparent to those skilled in the art to which the present invention relates upon reading the following description with reference to the accompanying drawings, in which.

DETAILED DESCRIPTION

The invention relates to burners and, more specifically, relates to an insertless inshot gas burner suitable for use in appliances. FIGS. 1-6 illustrate a burner nozzle 20 in accordance with an embodiment of the present invention. The burner nozzle 20 extends along a longitudinal centerline 26 from a first or inlet end 22 for receiving combustible gas and air to a second or outlet end 24 for releasing a mixture of the gas and air to be ignited.

Figure 1:
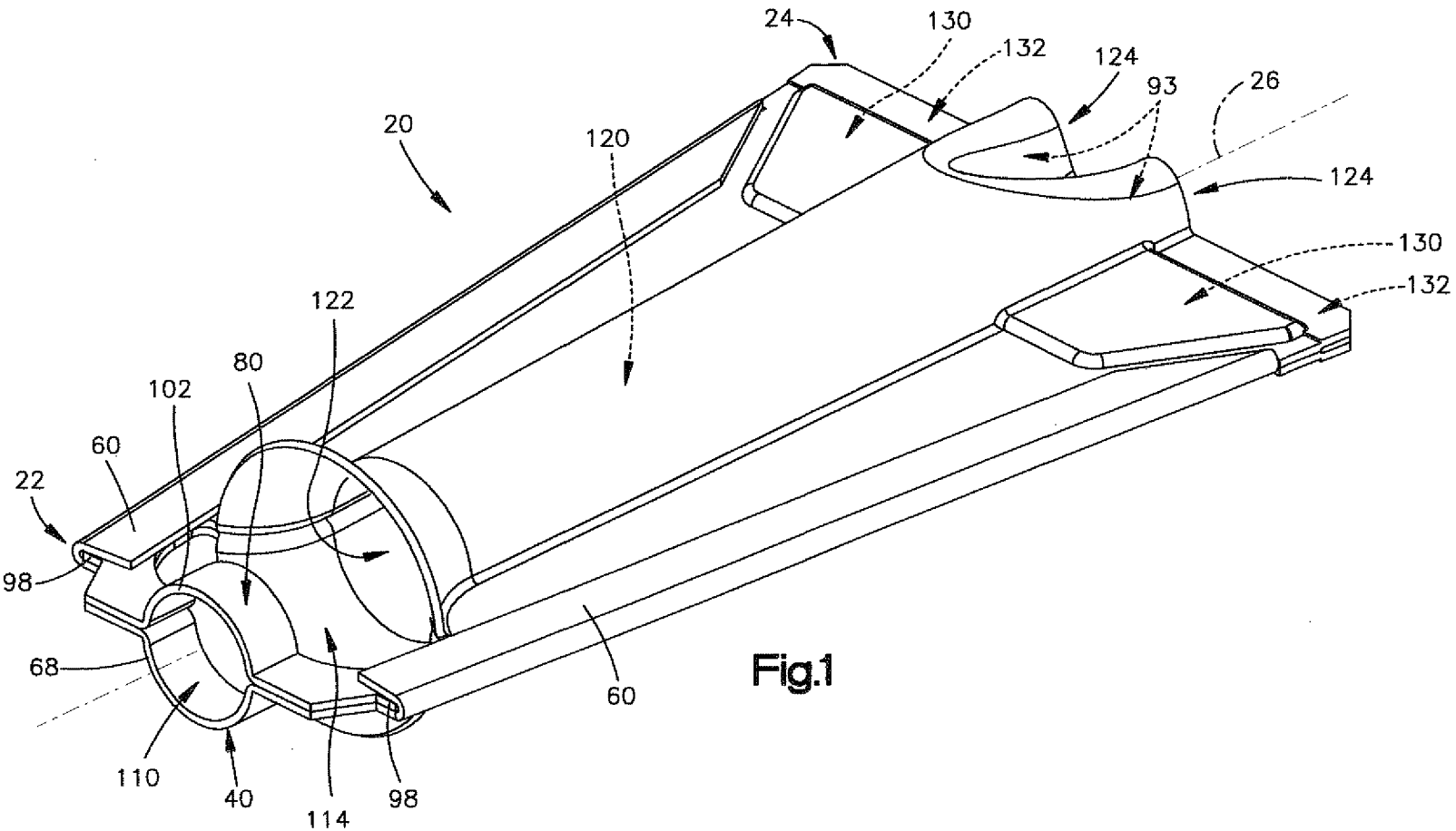
FIG. 1 is a schematic illustration of a burner nozzle in accordance with an embodiment of the present invention.
Figure 2:
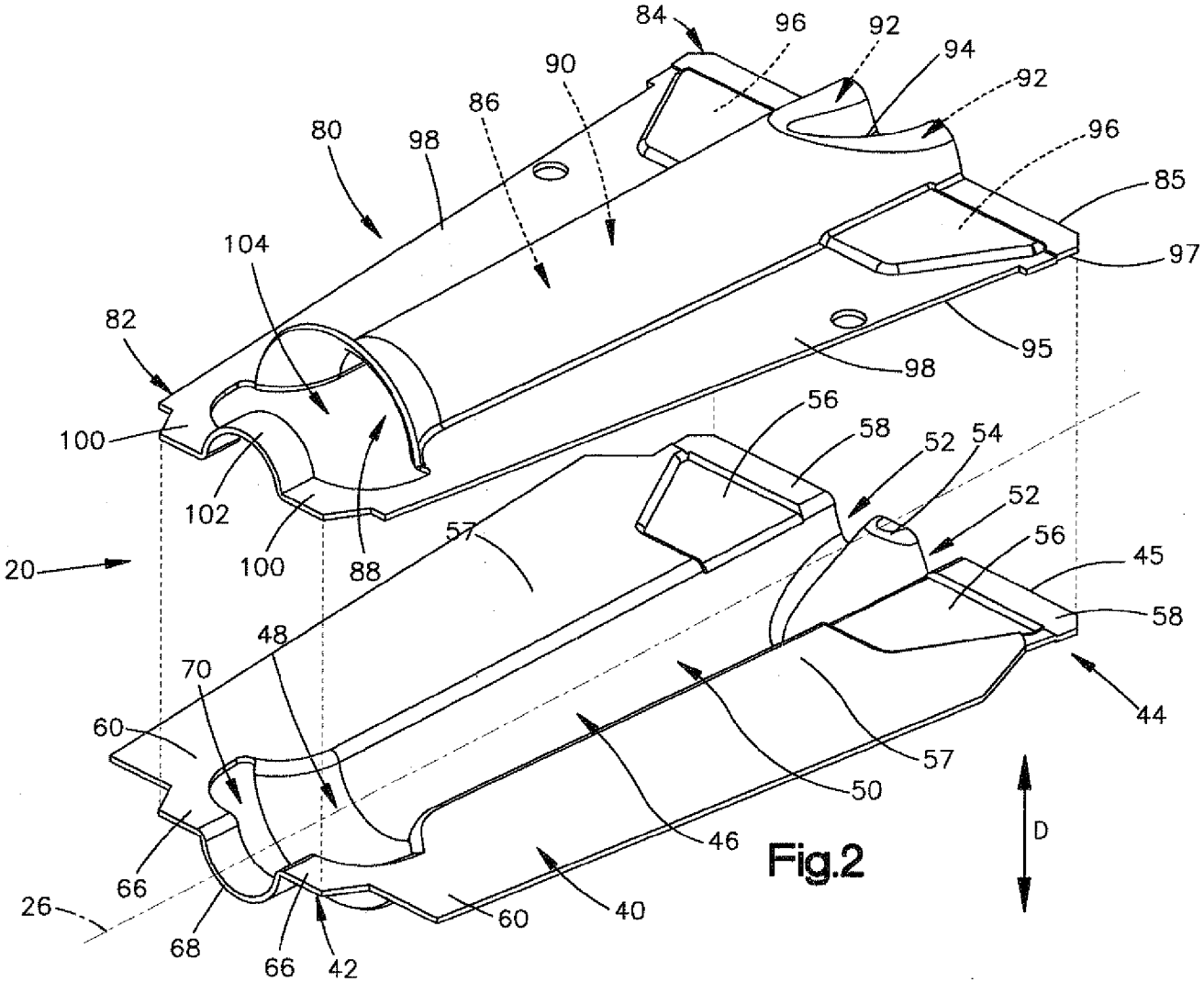
FIG. 2 is an exploded assembly view of the burner nozzle of FIG. 1.

As shown in FIGS. 1-2, the burner nozzle 20 is formed by a bottom member 40 and a top member 80 secured together. Although the members 40, 80 are described as being bottom and top members, respectively, these spatial references are made only in relation to FIGS. 1-2, and those skilled in the art will appreciate that each member may have any spatial orientation or relationship, e.g., top, bottom, left, right, etc., relative to the other member depending on the orientation of the burner nozzle 20 in the particular environment or application.

The burner nozzle 20 of the present invention may be formed form a single metal sheet or multiple sheets (not shown). Alternatively, the burner nozzle 20 may be formed from a single metal tube (not shown) formed into the burner nozzle. In the single sheet configuration, a die may be fabricated to stamp onto a single metal sheet an image containing the features of the top member 80 and the bottom member 40. The image may include mirror images for each member 40, 80 that are bent and formed into the configurations illustrated in FIGS. 1-2. The top and bottom members 80, 40 are secured to one another such that a gas-tight seal exists between the members. Although a single burner nozzle 20 is illustrated and described, it will be appreciated that more than one burner nozzle 20 may be formed in one stamping operation to produce an integrally connected block of burners (not shown).

The bottom member 40 has a generally planar construction and extends from a first end 42 to a second end 44 that terminates at a planar end face 45. The bottom member 40 may have a generally trapezoidal or triangular shape, although alternative shapes may be used. The bottom member 40 may be made from a metal, such as steel or aluminized steel. The contour of the bottom member 40 defines a recessed passage 46 that extends from the first end 42 to the second end 44. The passage 46 extends along the centerline 26 of the nozzle 20 and includes an entry or converging portion 48, a middle portion 50, and at least one exit portion 52. The converging portion 48 may have an arcuate or frustoconical shape that tapers inward towards the centerline 26 as the converging portion extends from the first end 42 towards the second end 44. The middle portion 50 of the passage 46 has a generally hemi-cylindrical shape and extends from the converging portion 48 towards the second end 44 of the bottom member 40. The tapered converging portion 48 of the passage 46 may be replaced with a straight portion such that the portion 48 and the middle portion 50 have similar or identical cross-sections (not shown).

A dimple 54 is formed in a second end 44 of the bottom member 40 to bifurcate the middle portion 50 of the passage 46 and form the exit portions 52. The dimple 54 is formed in the bottom member 40 such that the dimple intersects the planar end face 45, i.e., the planar end face defines the rightmost boundary of the dimple as viewed in FIG. 2. The dimple 54 therefore has the shape of a truncated ellipse when viewed from above (see FIG. 3) and may be formed anywhere along the outlet end 24 of the burner nozzle 20. Each exit portion 52 has an arcuate cross section and extends in a direction that is parallel to the centerline 26, although the dimple 54 may be configured to produce exit portions having other shapes. The dimple 54 is configured such that the cross-sectional area of each exit portion 52 decreases in a direction extending towards the second end 44 of the bottom member 40. Although FIG. 2 illustrates two exit portions 52 defined by a single dimple 54, those having ordinary skill will appreciate that more or fewer dimples may be provided in the bottom member 40 to form more or fewer exit portions in the second end 44 of the bottom member.

The contour of the bottom member 40 also defines recesses 56 that extend from each side of the passage 46 adjacent to the exit portions 52. Each recess 56 extends away from the centerline 26 towards the periphery of the bottom member 40 but terminates prior to the outer periphery. Each recess 56 may have any shape such as trapezoidal, rectangular, triangular, oval or the like. Although two recesses 56 are illustrated in FIG. 2, those having ordinary skill will appreciate that more or fewer recesses having identical or different shapes. Each recess 56 has a shallower depth in the direction indicated at D (perpendicular to the centerline 26) from a top surface 57 of the bottom member 40 than the depth of the passage 46 from the top surface. The recesses 56 may have the same depth in the direction D or different depths (not shown). Each recess 56 is spaced along the centerline 26 from the end face 45 by a flange 58 that includes and defines the end face. The flange 58 is positioned at a shallower depth in the direction D from the top surface 57 than the depth of the recess 56. It will be understood, however, that the flange 58 and the top surface 57 may be co-planar (not shown).

The periphery of the bottom member 40 includes a lip 60 that extends from the first end 42 towards the second end 44 but terminates prior to the flange 58. The lip 60 extends away from the centerline 26 and initially has a flat or planar configuration. The lip 60 is configured to mate with a portion of the top member 80 in order to secure the top member to the bottom member 40 in a fluid-tight manner to form the burner nozzle 20.

The first end 42 of the bottom member 40 includes a pair of flanges 66 connected to one another by an arcuate portion 68 extending below and about the centerline 26. A gap 70 extends entirely through the bottom member 40 and is provided along the centerline 26 between the arcuate portion 68 connecting the flanges 66 and the converging portion 48 of the passage 46. The gap 70 is sized and shaped to promote air flow into the converging portion 48 of the passage 46.

The top member 80 has a generally planar construction and, when assembled with the bottom member 40, extends along the centerline 26 from a first end 82 to a second end 84 that terminates at a planar end face 85. The top member 80 may have a generally trapezoidal or triangular shape, although alternative shapes may be used. In any case, the top member 80 is configured to have a shape that corresponds with the shape of the bottom member 40. More specifically, the top member 80 is configured to be substantially identical to the bottom member 40. The top member 80 may be made from a metal, such as steel or aluminized steel.

The contour of the top member 80 defines a recessed passage 86 that extends from the first end 82 to the second end 84 of the top member. The passage 86 extends along the centerline 26 of the nozzle 20 and includes a converging portion 88, a middle portion 90, and at least one exit portion 92. The converging portion 88 may have an arcuate or frustoconical shape that tapers towards the centerline 26 inward as the converging portion extends from the first end 82 towards the second end 84. The middle portion 90 of the passage 86 has a generally hemispherical cross section and extends from the converging portion 88 towards the second end 84 of the top member 80. The tapered converging portion 88 of the passage 86 may be replaced with a straight portion such that the portion 88 and the middle portion 90 have similar or identical cross-sections (not shown). It is desirable, but not imperative, that the passage 86 has the same configuration as the passage 46 of the bottom member 40.

A dimple 94 is formed in the second end 84 of the top member 80 to bifurcate the middle portion 90 of the passage 86 and form the exit portions 92. The dimple 94 is formed in the top member 80 such that the dimple intersects the planar end face 85, i.e., the planar end face defines the rightmost boundary of the dimple as viewed in FIG. 2. The dimple 94 therefore has the shape of a truncated ellipse when viewed from above (see FIG. 3). Each exit portion 92 has an arcuate cross-section in a direction that is parallel to the centerline 26. The dimple 94 is configured such that the cross-sectional area of each exit portion 92 decreases in a direction extending towards the second end 84 of the top member 80. The dimple 94 is configured such that the number, location, and shape of the exit portions 92 corresponds with the number, location, and shape of the exit portions 52 in the bottom member 40.

The contour of the top member 80 also defines recesses 96 that extend from each side of the passage 86 adjacent to the exit portions 92. Each recess 96 extends towards the periphery of the top member 80 but terminates prior to the outer periphery. The recesses 96 are shaped and positioned relative to the passage 86 to correspond with the shapes and positions of the recesses 56 relative to the passage 46 in the bottom member 40. Each recess 96 has a shallower depth in the direction D (perpendicular to the centerline 26) from a bottom surface 95 of the top member 80 than the depth of the passage 86 from the bottom surface. Each recess 96 is spaced along the centerline 26 from the end face 85 by a flange 97 that includes and defines the end face. The flange 97 is positioned at a shallower depth in the direction D from the bottom surface 95 than the depth of the recess 96. It will be appreciated, however, that the flange 97 and the bottom surface 95 may be co-planar (not shown). The recesses 96 may therefore have the same depth in the direction D as one another or the depths may be different (not shown). It will also be understood that the recesses 96 may have the same depth in the direction D relative to the bottom surface 95 as the depth of the recesses 56 relative to the top surface 57 or the depths may be different.

The first end 82 of the top member 80 includes a pair of flanges 100 connected to one another by an arcuate portion 102 extending below and about the centerline 26. A gap 104 extends entirely through the top member 80 and is provided along the centerline 26 between the arcuate portion 68 connecting the flanges 100 and the converging portion 88 of the passage 86. The gap 104 is sized and shaped to promote air flow into the converging portion 98 of the passage 96.

The periphery of the top member 80 includes an edge portion 98 that extends from the first end 82 towards the second end 84 and terminates at the flange 97. The edge portion 98 extends away from the centerline 26 and is configured to mate with the lip 60 of the bottom member 40 in order to secure the top member to the bottom member in a fluid-tight manner to form the burner nozzle 20. Referring to FIG. 2, the lips 60 on the top member 80 are aligned with and engage the edge portions 98 of the bottom member 40. The lips 60 are then folded over the edge portions 98 such that the lips exhibit the U-shaped construction illustrated in FIG. 1. Alternatively or additionally, the lips 60 and the edge portions 98 are secured to one another by conventional metal fastening techniques, such as upset metal fastening, adhesive or welding. Additional structure may be provided integral to or separate from the top and bottom members 80, 40 to provide a leak-proof connection between the members, e.g., a seal provided between the members (not shown).

Figure 3:
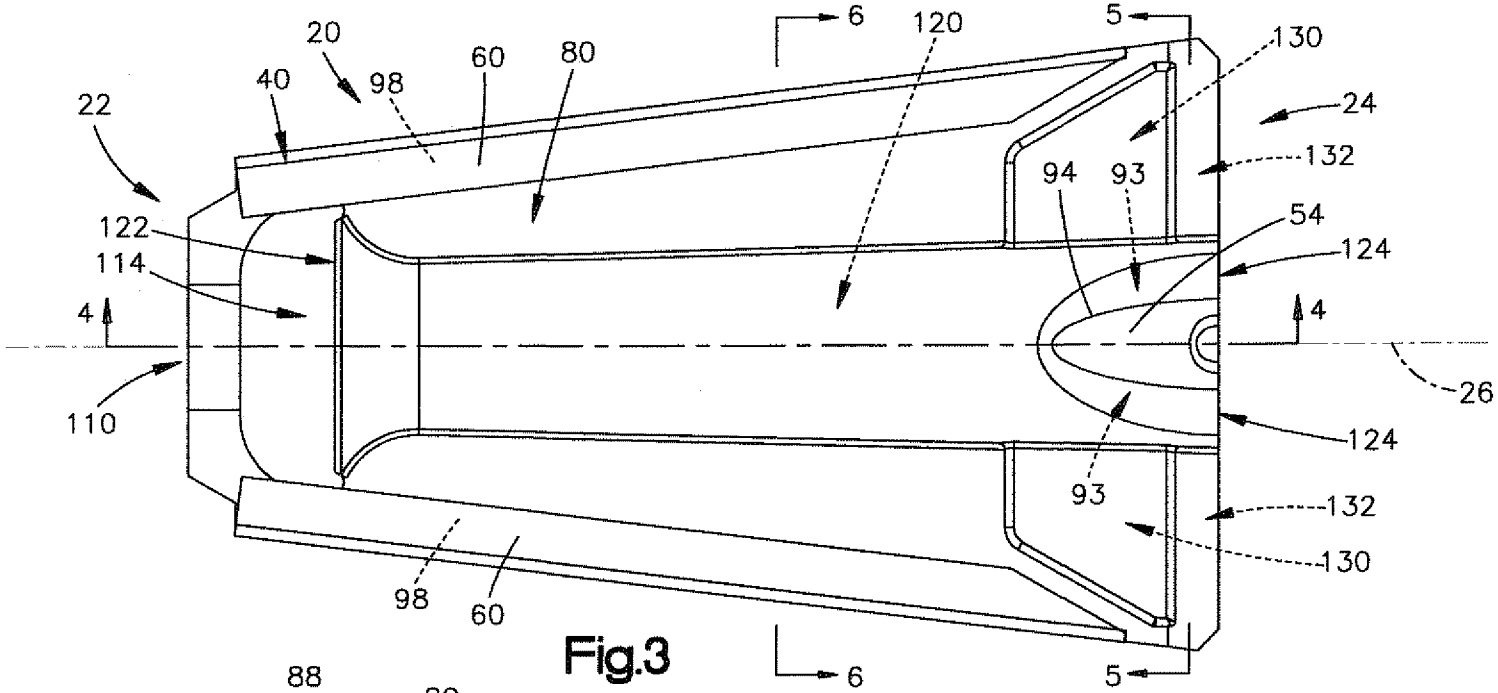
FIG. 3 is a top view of the burner nozzle of FIG. 1.
Figure 4:
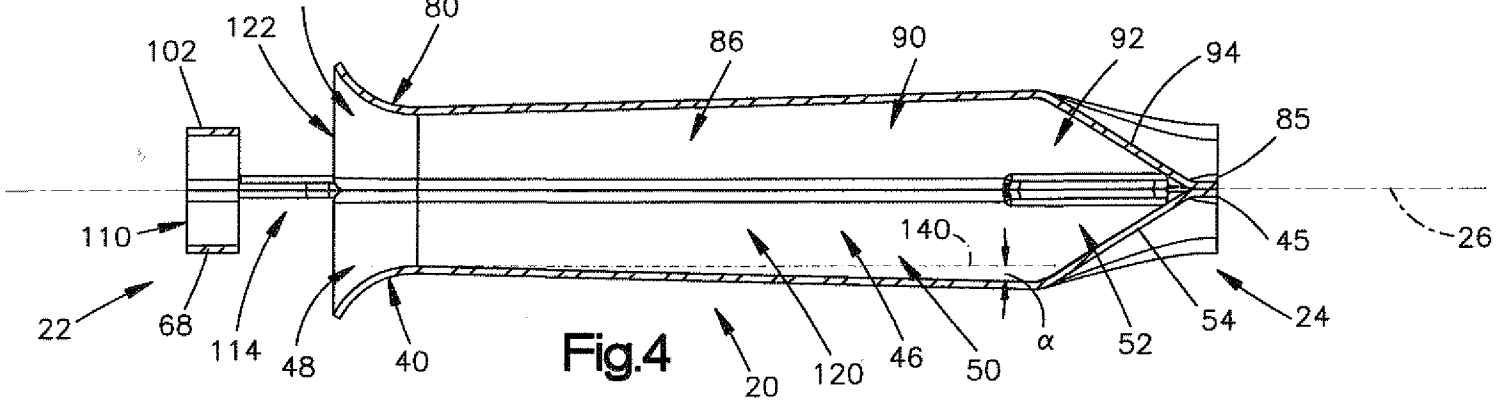
FIG. 4 is a section view taken along line 4-4 of the burner nozzle of FIG. 3.

As shown in FIGS. 1 and 3-4, when the edge portions 98 of the top member 80 are positioned within the folded-over lips 60 on the bottom member 40 portions of the top member are aligned with portions of the bottom member to form elements of the burner nozzle 20. In particular, the flanges 66 on the bottom member 40 engage and align with the flanges 100 on the top member 80. In this configuration, the arcuate portion 68 on the bottom member 40 cooperates with the arcuate portion 102 on the top member 80 to form an opening 110 in the inlet end 42 of the burner nozzle 20 for receiving a gas supply (not shown). The term "gas" is used herein in reference to combustible fuel in gaseous form. It will be appreciated that any suitable gaseous combustible fuel may be used, such as natural gas, propane, butane, and other gas mixtures depending on the particular application.

The gap 70 in the bottom member 40 cooperates with the gap 104 in the top member 80 to form an air supply gap 114 between the opening 110 and the converging portion 122. Those skilled in the art will appreciate that the size of the air supply gap 114 may be adjusted as desired to be fixed upon fabrication or may be variable using a conventional shutter (not shown), depending upon the air flow requirements of the particular application.

The top and bottom members 80, 40 also cooperate to form enclosed fluid passages in the burner nozzle 20 for the air and combustible gas. The passage 46 in the bottom member 40 cooperates with the passage 86 in the top member 80 to form a central supply passage 120 for mixing air and gas. The central supply passage 120 extends along the centerline 26 between the inlet end 22 and the outlet end 24 of the burner nozzle 20. The central supply passage 120 has a generally circular cross-section that forms a venturi in a well known manner, although the top and bottom members 80, 40 may be configured to form a central supply passage that exhibits any shape or shapes in accordance with the present invention. For example, the top and bottom members 40, 80 may form a central supply passage 120 that is symmetric or asymmetric about the centerline 26. As shown in FIG. 4, the contour of the top and bottom members 80, 40 are tapered such that the cross-section of the central supply passage 120 expands radially outward relative to the centerline 26 in a direction extending towards the outlet end 24 of the burner nozzle 20. In particular, the walls of the top and bottom members 80, 40 extend at an angle, indicated at $\alpha$, relative to an axis 140 that is parallel to the central axis 26 of the burner nozzle 20 such that a portion of the central supply passage 120 exhibits a frustoconical shape. Alternatively, the walls of the top and bottom members 80, 40 may extend parallel to the centerline 26 (not shown).

The converging portion 48 in the bottom member 40 and the converging portion 88 in the top member 80 cooperate to form a frustoconical converging portion 122 that leads to the central supply passage 120. The portion 122 converges towards the centerline 26 in a direction extending towards the outlet end 24 of the burner nozzle 20. The dimples 54, 94 at the outlet end 24 of the burner nozzle 20 cooperate to align the exit portions 52 in the bottom member 40 with the exit portions 92 in the top member 80, which forms nozzles or exit portions 93 having openings 124. The exit openings 124 are positioned adjacent to the end faces 45, 85 of the bottom and top members 40, 80, respectively. Due to the configuration of the dimples 34, 94 the nozzles or exit portions 93 exhibit a circular or oval cross-section that decreases in a direction extending toward the respective exit opening 124. The nozzles or exit portions 93 and openings 124 of the present invention are therefore formed and defined entirely by portions of the top and bottom members 80, 40, i.e., by the dimples 54, 94 in the top and bottom members—not by a separate insert provided between the top and bottom members 80, 40 as is customary in the prior art.

Figure 5:
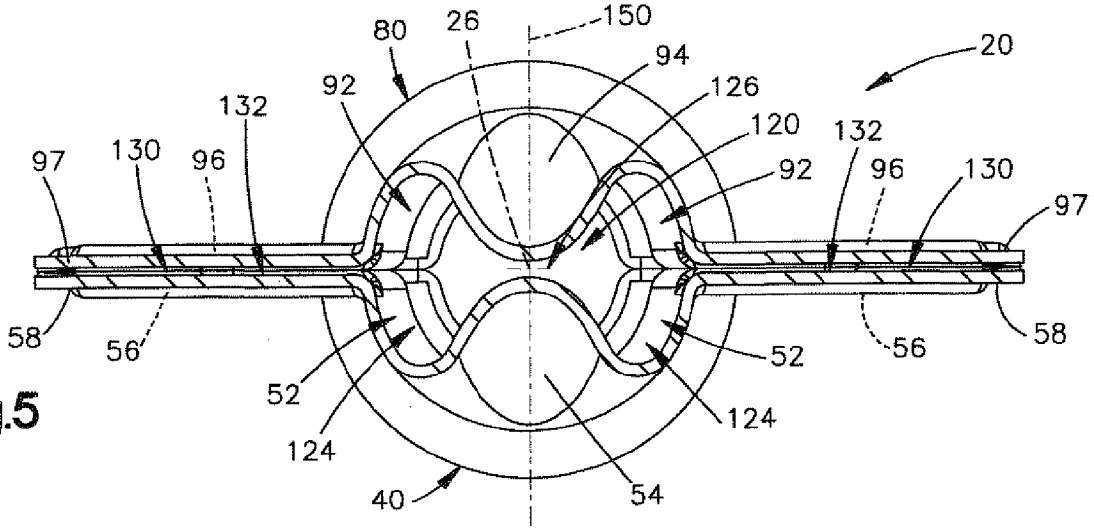
FIG. 5 is a section view taken along line 5-5 of the burner nozzle of FIG. 3.
Figure 6:
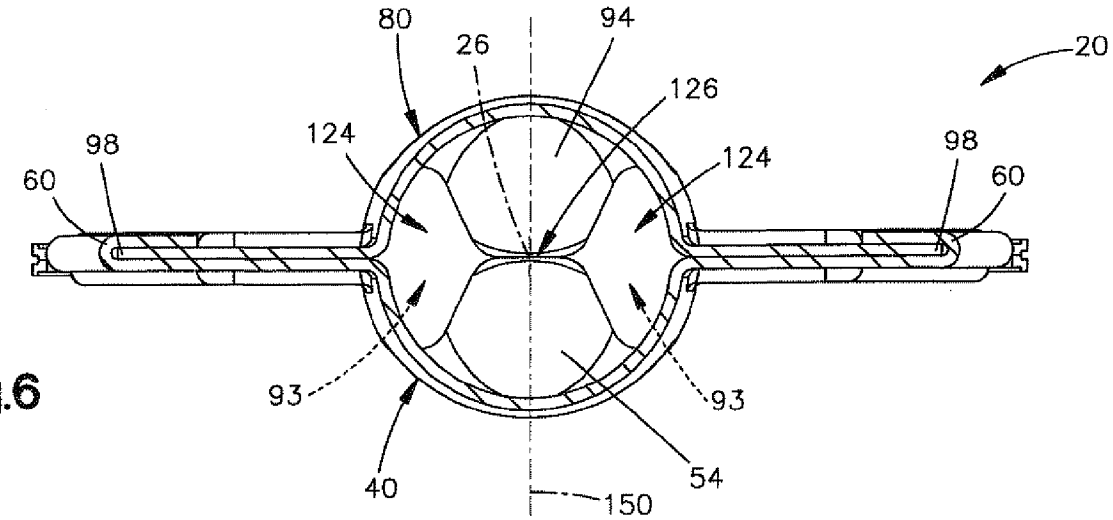
FIG. 6 is a section view taken along line 6-6 of the burner nozzle of FIG. 3.

As shown in FIGS. 5-6, the exit openings 124 have a generally circular or oval shape and are positioned on opposing sides of a vertical axis 150 extending through the dimples 54, 94. Those having ordinary skill will appreciate that more or fewer exit openings 124 may be provided at any orientation relative to one another and the axis 150 depending on the number and position of the dimples 54, 94, e.g., the exit openings may be angled relative to one another or asymmetrically positioned about the axis 150. The dimples 54, 94 may be formed such that a gap 126 extends between the dimples and narrows in a direction towards the outlet end 24 of the burner nozzle 20 until the gap disappears where the dimples contact one another (FIG. 5). Alternatively, the dimples 54, 94 may be formed such that a small gap 126 persists along the entire length of the dimples, i.e., the dimples never touch one another (not shown).

Plenum chambers 130 are formed by the recesses 56, 96 and the flanges 58, 97 of the bottom member 40 and top member 80, respectively, on opposite sides of the exit portions 93 in a direction perpendicular to the centerline 26. In this construction, the plenum chambers 130 may be spaced apart from each other by about 180° relative to the centerline 26. Each plenum chamber 130 is in fluid communication with the exit portions 93 and the central supply passage 120. Each plenum chamber 130 extends transverse to the centerline 26 and to the end faces 45, 85 of the bottom and top members 80, 40. Although a pair of plenum chambers 130 is shown, more or fewer plenum chambers may be provided in the burner nozzle 20, including zero, depending on the application.

As shown in FIG. 4, each plenum chamber 130 fluidly communicates with a corresponding exit opening 124 with both the plenum chambers and the exit openings co-terminating at the plane of the end faces 45, 85. Each plenum chamber 130 has a first height (not shown) along the axis 150 corresponding with the cumulative depth of the recesses 56, 96 along the axis 150 and relative to the surfaces 57, 95, respectively. A portion 132 of each plenum chamber 130 is defined between the flanges 58, 97 and has a second, different height (not shown) along the axis 150 corresponding with the cumulative depth of the flanges 58, 97 along the axis 150 and relative to the surfaces 57, 95, respectively. The portions 132 terminate at the end faces 45, 85. This configuration of the flanges 58, 97 results in a pressure inside the plenum chambers 130 which is approximately the same as the pressure inside the gas supply passage 120.

The portion 132 of each plenum chamber 130 formed between the flanges 58, 97 is an optional feature in that the portion is provided to assist in lighting adjacent burner nozzles 20 in multi-nozzle constructions (not shown). In particular, the portion 132 acts as a carry-over and interacts with portions 132 in adjacent burner nozzles 20 to fluidly connect multiple burner nozzles with one another. In a single burner nozzle 20 configuration, however, the flanges 58, 97 may be co-planar with the surface 57 and 95, respectively, such that the portions 132 of the plenum chambers 130 are omitted (not shown).

In operation, combustible gas is fed into the inlet end 22 of the burner nozzle 20 from the gas supply in the opening 110 in a manner known to those skilled in the art. As the gas flows by the air supply gap 114 it entrains air into the central supply passage 120. The air and gas mix in the venturi of the central supply passage 120 and travel toward the outlet end 24 of burner nozzle 20. A principal portion of the air and gas flows through the central supply passage 120 and generally along the centerline 26 to the exit openings 124, where the air/gas mixture exits the burner nozzle 20. The remaining portion of the air and gas flows away from the centerline 26 at the outlet end 24 into each plenum chamber 130, where it exits the burner nozzle 20 at the plane of the end faces 45, 85. The mixture of air and combustible gas exiting the burner nozzle 20 at the exit openings 124 and the plenum chambers 130 is subsequently ignited in a known manner (not shown).

The burner nozzle 20 of the present invention is suitable for use with both horizontal and vertical flows of the air/gas mixture. In other words, the burner nozzle 20 of the present invention may be vertically or horizontally mounted in the desired application. A characteristic of horizontal firing is that the flame has a tendency to rise and, thus, the burner nozzle 20 may be designed to accommodate this characteristic. Other concerns are avoiding flashback and liftoff. Flashback can be eliminated by keeping the velocity of the gas/air mixture above the flame speed, which generally requires high port loadings. Unfortunately, high port loadings can cause flame liftoff. Consequently, the burner design of the present invention incorporates a high velocity zone near the flame front, i.e., near the exit openings 124, to prevent flashback while also incorporating a zone of low velocity and/or turbulence to improve flame stability and prevent liftoff.

The construction of the burner nozzle 20 of the present invention is configured such that desirable flame retention and stability as well as improved mixing of gas and air within the central supply passage 120 is achieved without the need to provide a separate insert at the outlet end 24 of the burner nozzle. In particular, the configuration of the dimples 54, 94 formed at the outlet end 24 of the burner nozzle 20 of the present invention provides a "bluff body" structure that induces downstream turbulence and provides a low velocity zone that is very effective in stabilizing the flame front at the outlet end. This dimple structure also creates a pair of converging nozzles which gradually increase the mixture velocity as the cross-sectional area decreases towards the outlet end 24, with maximum velocity being reached at the exit openings 124. The high velocity discharge of the air and gas mixture created by the converging exit portions 92 helps prevent flashback within the burner nozzle 20. Accordingly, the simple, two-piece configuration of the burner nozzle 20 of the present invention combines the low cost of an insertless burner with the expanded operating range of insert type burners.

The preferred embodiments of the invention have been illustrated and described in detail. However, the present invention is not to be considered limited to the precise construction disclosed. Various adaptations, modifications and uses of the invention may occur to those skilled in the art to which the invention relates and the intention is to cover hereby all such adaptations, modifications, and uses which fall within the spirit or scope of the appended claims.

Having described the invention, the following is claimed:

1. A burner nozzle for use in burning a gas/air mixture comprising:

a tubular member extending along a centerline and having a mixture supply passage that extends from an inlet end that receives air and gas to an outlet end, the outlet end including a plurality of exit portions in fluid communication with the inlet end, the exit portions being positioned on opposing sides of cooperating dimples formed in the tubular member, the dimples being configured to shape the exit portions into nozzles having a cross-sectional area that decreases in a direction towards the outlet end.

2. The burner nozzle of claim 1, wherein the mixture supply passage includes a converging portion at the inlet end, the plurality of exit portions at the outlet end, and a central portion fluidly connecting the converging portion to the exit portions.

3. The burner nozzle of claim 2, wherein the central portion tapers outward relative to the centerline in a direction extending from the inlet end toward the outlet end.

4. The burner nozzle of claim 2, wherein the converging portion tapers inward towards the centerline in a direction extending from the inlet end toward the outlet end.

5. The burner nozzle of claim 2, wherein the dimples bifurcate the mixture supply passage and engage one another to form the nozzles.

6. The burner nozzle of claim 1, wherein the dimples constitute indentations formed in the tubular member to place the nozzles on opposite sides of the centerline.

7. The burner nozzle of claim 1, wherein the dimples are spaced from one another by a gap that narrows in a direction extending towards the outlet end until the dimples contact one another.

8. The burner nozzle of claim 7, wherein the gap fluidly connects the nozzles to one another.

9. The burner nozzle of claim 1 further comprising plenum chambers extending outward from the mixture supply passage and positioned on opposite sides of the centerline.

10. The burner nozzle of claim 9, wherein each plenum chamber includes a first portion have a first depth and a second portion having a second, different depth.

11. The burner nozzle of claim 1, wherein the cross-sectional area of each nozzle continuously decreases until each nozzle terminates at an exit opening such that the gas/air mixture has a maximum velocity at the exit openings.

12. The burner nozzle of claim 1, wherein each nozzle has one of a circular or oval shape.

13. The burner nozzle of claim 1, wherein the tubular member is formed by substantially identical first and second members secured together.

14. The burner nozzle of claim 1 further comprising plenum chambers extending outward from the mixture supply passage and positioned on opposite sides of the centerline, wherein the outlet end terminates at a planar end face, the dimples intersecting the planar end face and extending between the plenum chambers.

15. A burner nozzle extending along a centerline from an inlet end to an outlet end for use in burning a gas/air mixture comprising:

first and second stamped members secured together to form an enclosed mixture supply passage that extends from the inlet end to the outlet end, the mixture supply passage comprising:

a frustoconical converging portion for receiving air and gas at the inlet end;

a central portion in fluid communication with the converging portion and being tapered relative to the centerline; and a plurality of exit portions at the outlet end in fluid communication with the converging portion, the exit portions being positioned on opposing sides of cooperating dimples formed in the first and second stamped members, the dimples being configured to shape the exit portions into nozzles having a cross-sectional area that decreases in a direction extending towards the outlet end.

16. The burner nozzle of claim 15, wherein the dimples cooperate to form a bluff body that induces downstream turbulence in the gas/air mixture in the exit portions.

17. The burner nozzle of claim 15, wherein the cross-sectional area of each nozzle continuously decreases until each nozzle terminates at an exit opening such that the gas/air mixture has a maximum velocity at the exit openings.

18. The burner nozzle of claim 15, wherein the dimples are spaced from one another by a gap that narrows in a direction extending towards the outlet end until the dimples contact one another.

19. The burner nozzle of claim 15, wherein the first and second stamped members are substantially identical.

20. The burner nozzle of claim 15 further comprising plenum chambers extending outward from the mixture supply passage, wherein the outlet end terminates at a planar end face, the dimples intersecting the planar end face and extending between the plenum chambers.

* * * * *